United States Patent [19]

Schmitz

[11] 4,249,997

[45] Feb. 10, 1981

[54] LOW DIFFERENTIAL COKE OVEN HEATING SYSTEM

[75] Inventor: Norbert J. Schmitz, North Collins, N.Y.

[73] Assignee: Bethlehem Steel Corporation, Bethlehem, Pa.

[21] Appl. No.: 970,597

[22] Filed: Dec. 18, 1978

[51] Int. Cl.[3] ..... C10B 1/06; C10B 5/04; C10B 5/12; C10B 21/06

[52] U.S. Cl. ..... 202/142; 202/143; 202/144; 202/151; 202/223

[58] Field of Search ..... 202/135, 139, 141, 142, 202/143, 144, 151, 223

[56] References Cited

U.S. PATENT DOCUMENTS

| | | | |
|---|---|---|---|
| 3,170,851 | 2/1965 | Van Ackeren | 202/144 |
| 3,192,129 | 6/1965 | Becker | 202/143 |
| 3,366,372 | 1/1968 | Palumbo | 202/143 X |
| 3,801,470 | 4/1974 | Knappstein et al. | 202/142 |
| 4,004,983 | 1/1977 | Pries | 202/142 |

OTHER PUBLICATIONS

E. J. Helm, "High Coke Ovens", pp. 53-59, Ironmaking Proceedings, 1966.

*Primary Examiner*—Joseph Scovronek
*Attorney, Agent, or Firm*—Joseph J. O'Keefe; Charles A. Wilkinson; Michael Leach

[57] ABSTRACT

A regenerative coke oven battery that produces a coke cake having a low vertical temperature differential throughout its mass. The heating flues are defined by header walls having ducts for air or lean gas and outlet slots incorporated along the vertical length of the header wall which slots connect the ducts with the flues. The flues are combined into groups connected at their upper ends with a horizontal bus channel which communicates by a cross-over duct with a similar horizontal bus channel on the opposite side of a coking chamber.

3 Claims, 4 Drawing Figures

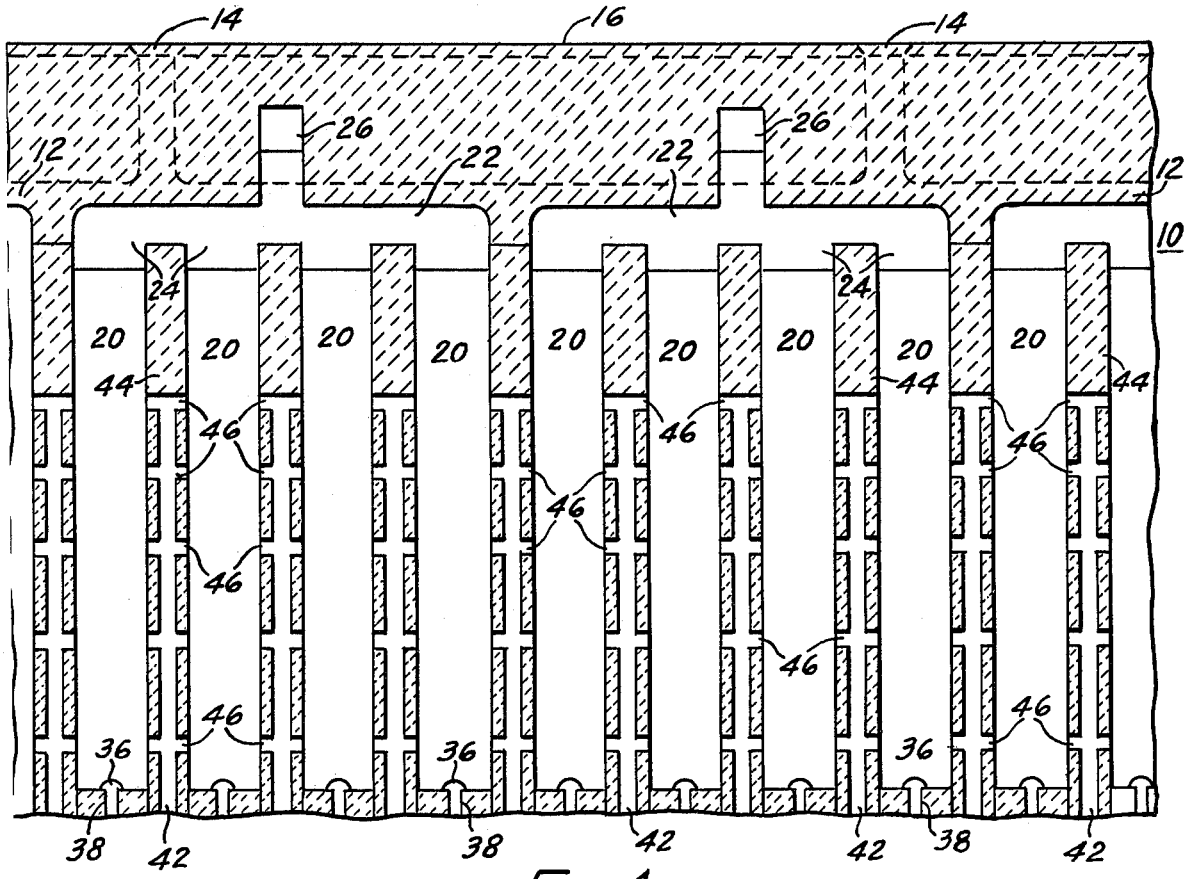
FIG. 4
FIG. 1
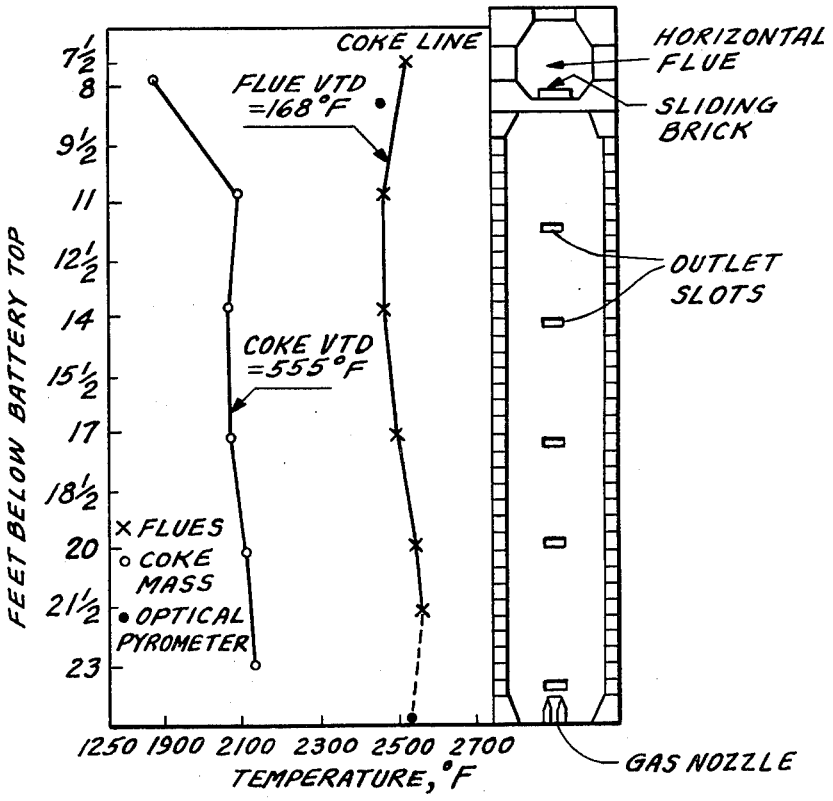

LOW DIFFERENTIAL COKE OVEN HEATING SYSTEM

FIELD OF THE INVENTION

This invention relates to regenerative coke ovens and, more particularly, to regenerative coke ovens having multistage vertical heating flues.

BACKGROUND OF THE INVENTION

Coke for use in metallurgical processes or the like is usually made in retort ovens customarily consisting essentially of coking chambers, heating walls and regenerators, all formed from refractory brick. The coking chambers are rectangular, perhaps 30 to 50 feet long, 10 to 20 feet in height and 1 to 2 feet in width. Heating walls are positioned on each side of the coking chambers. A number of alternately side by side coking chambers and heating walls constitute a battery of ovens. The regenerators are located under the coking chambers and heating walls. In operation coal is placed in the coking chambers and heated by gas burned in the flues within the heating walls in regular alternating relationship. Combustion air is preheated in the regenerators. After a number of hours the resulting coke is pushed mechanically from one end of the vertical coking chambers. The coal particles tend to adhere to each other during the heating cycle of the coking process and emerge from the coking chamber in a more or less coherent cake of hot glowing coke which is not strong enough to support its own weight and breaks off into smaller lumps as it is progressively pushed from the oven.

The goal of any coke oven heating system is to afford a coke cake that is thoroughly and uniformly coked throughout its mass when the cake is pushed. The vertical temperature profile of the pushed coke cake should be relatively constant, i.e., the temperature from the top to the bottom of the coke cake should ideally be substantially the same. The variation in temperature that exists along the vertical height of the coke cake is known as the vertical temperature differential. If the vertical temperature profile is not constant, a "green" push may result that not only yields coke of poor quality but also generates substantial emissions which may pollute the environment.

While it is desirable to have a low vertical temperature differential, the construction of the walls between the coking chambers necessitated in order to achieve structural strength and the fact that gas flames vary in intensity along their length have often resulted in coke cakes having a rather large, or high, vertical temperature differential, particularly near the top of the cake.

Prior art proposals to solve this problem endeavored to achieve a low vertical temperature differential within the coking chamber and, thus, within the coke cake itself by providing a heating flue system that has a small temperature drop from the base to the top of the vertical heating flues.

The basic design of the Koppers-Becker heating system, which is shown in various embodiments in U.S. Pat. Nos. 2,100,762; 2,255,406; 2,306,366; 3,192,129 and other patents issued to J. Becker, was an early attempt at a low differential heating system. Groups of adjacent vertical flues communicate with short horizontal flues which are connected by cross-over flues running over the top of the coking chamber to corresponding horizontal and vertical flues in the heating wall on the opposite side of the coking chamber. In actuality, this heating system resulted in a relatively large temperature differential along the height of the vertical flues with a concomitant large vertical temperature differential in the coke mass. Typical vertical temperature profiles of non-multistage heating systems such as the Koppers-Becker heating system are shown in FIG. 6 of "High Coke Ovens" by E. J. Helm, *Ironmaking Proceedings*, 1966, pp 53–57. The upper part of the coke cake will exhibit the greatest temperature drop since the upper part of the heating flues possess the lowest temperature. To achieve a coke cake which is sufficiently coked in the upper portion would necessitate extended coking cycles and limited coking rates resulting in over-coking of the lower portion of the coke and a waste of fuel. Several methods used currently, with limited success, to alleviate this problem are proportioning the lean gas and/or air between high and low ports within the flues and recirculating part of the waste gases to elongate the flame within the flue.

U.S. Pat. No. 3,801,470 discloses the well-known Firma Carl Still multistage heating system which is a half-divided system utilizing large horizontal flues to conduct the waste gases from the half of the vertical flues which are burning across the battery to the other half through which the waste gases are removed. The vertical temperature profile is relatively constant in the heating flue as well as in that portion of the coke cake up to the level corresponding to the height of the horizontal flue. The heavy brickwork of the horizontal flue, however, apparently interferes with the transfer of heat to the upper part of the coking chamber resulting in a large temperature drop-off in the upper portion of the coke cake.

U.S. Pat. No. 3,953,299 discloses a coke oven having a heating wall with only low burners on one side of a coking chamber and a heating wall having only high burners on the other side of the coking chamber. A more acceptable vertical temperature differential in the oven coking chamber is achieved by this arrangement, but the temperature of the top of the coke cake is still not well equalized with the temperature of the lower portions of the coke cake.

Accordingly, there is a need for a coke oven heating system that affords a pushed coke cake with a low vertical temperature differential through the entire height of the coke ovens.

There is also a need for a coke oven heating system that produces in an acceptable, relatively short coking time a coke cake having a low vertical temperature differential.

SUMMARY OF THE INVENTION

I have discovered a heating system design for a regenerative coke oven battery heated with rich gas or lean gas that produces a coke cake having a low vertical temperature differential. The battery has a plurality of horizontal coking chambers and a heating wall between each coking chamber. The heating wall contains a plurality of vertical heating flues which are defined by header walls provided with header ducts for conveying air or lean gas and multilevel outlet slots connecting the header ducts and the heating flues. Regenerators communicate via duct work with the header ducts and with waste gas exhaust means and lean gas and air sources. Horizontal bus channels are located above the vertical heating flues. Each channel communicates with a group of adjacent vertical heating flues and with a cross-over duct which extends over the top of a coking chamber connecting the horizontal bus channel of a first group of flues with the horizontal bus channel of a second group of flues located on the opposite side of a coking chamber.

DESCRIPTION OF THE DRAWINGS

FIG. 1 is a graphical representation of the vertical temperature profiles of the coal charge and the flue in a conventional multistage coke oven.

FIG. 4 is a vertical section taken along line 4—4 of FIG. 3.

DETAILED DESCRIPTION OF THE INVENTION

FIG. 1 shows the vertical temperature profiles of the coke mass within the coking chamber and of the flue system of a Firma Carl Still multistage heating system operating on rich gas, five minutes after off reverse in the flues, 14½ hr after charging the coke mass. The graphical representation of the vertical temperature profiles are in juxtaposition with a vertical sectional view of a heating wall of the Firma Carl Still heating system showing its multistage combustion design and the horizontal flue. The vertical temperature profile of the flue system is relatively attractive in that the vertical temperature differential (VTD) is only 168° F. While the vertical temperature profile of the coke cake sandwiched between two walls containing these multistage heating flues and a horizontal flue is also relatively attractive throughout most of its height, there is a sharp drop-off in temperature in the upper part of the coke mass, thus yielding a large over-all VTD of 555° F. As one can readily see, the major temperature decline in the coke cake corresponds to the location of the horizontal flue in the heating wall. The massive brickwork associated with this structure apparently prevents the efficient flow of the heat from the horizontal flue to the coal charge.

Figure 2:
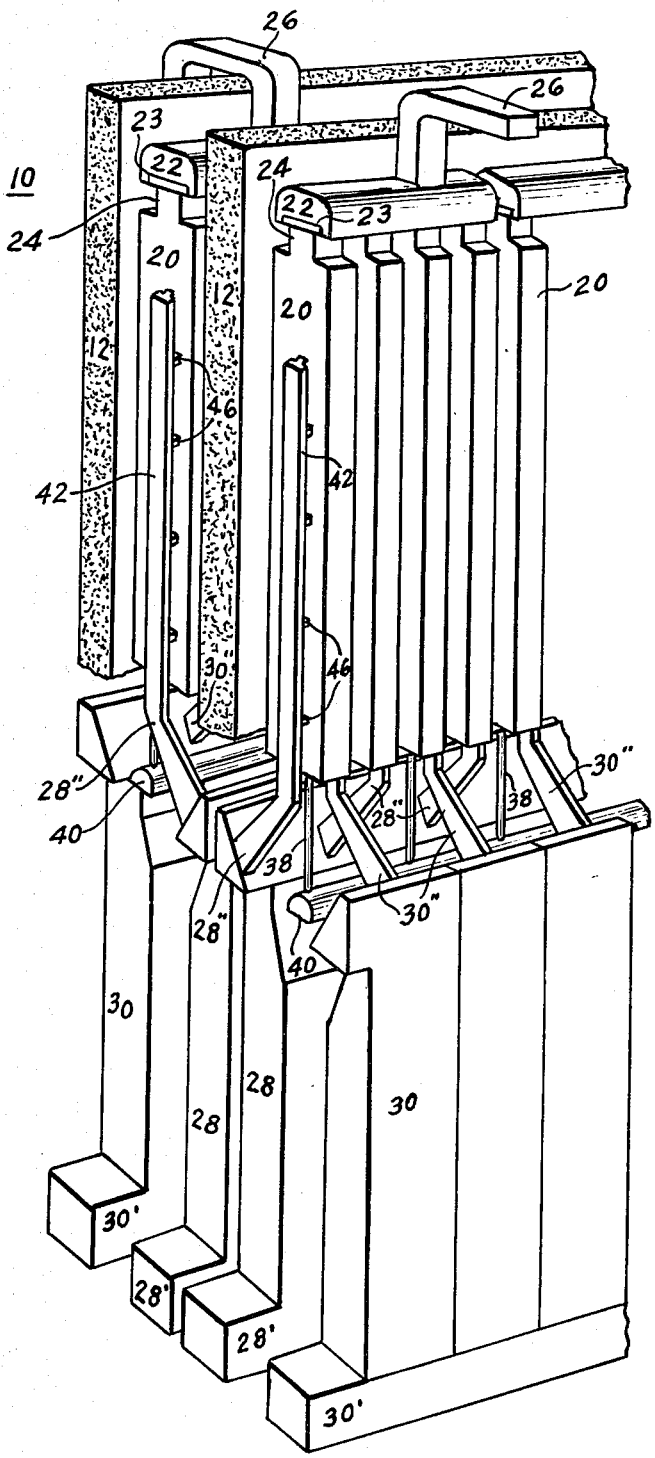
FIG. 2 is an isometric sectional view of a coke oven battery embodying the features of this invention.
Figure 3:
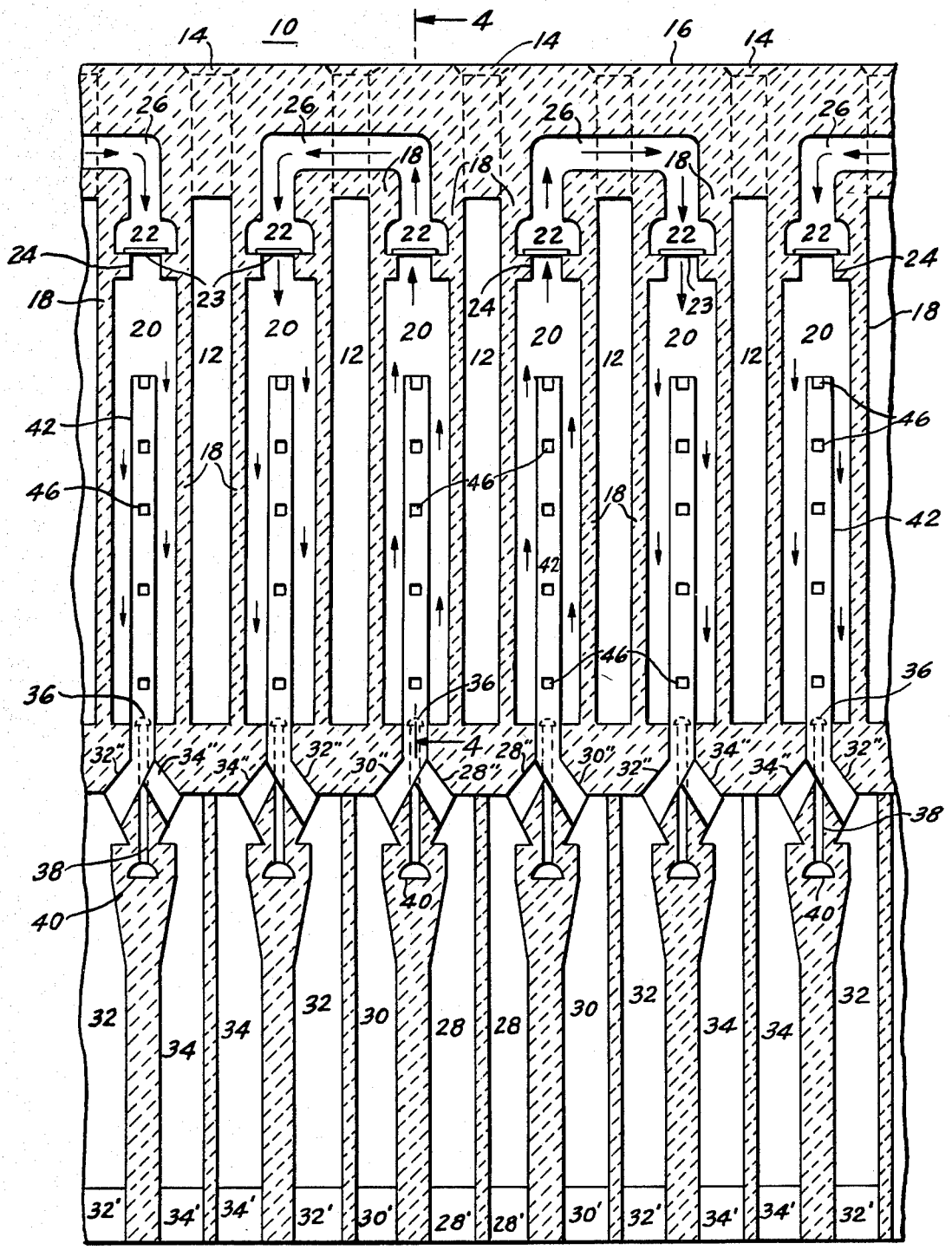
FIG. 3 is a lengthwise vertical section through a coke oven battery embodying the features of this invention.

FIGS. 2, 3 and 4 show a coke oven battery 10 in accordance with the invention having a plurality of horizontal coking chambers 12 which are filled with a coal charge through charging holes 14 in refractory roof 16. Disposed between each coking chamber 12 is a heating wall 18 containing a plurality of vertical heating flues 20 which are connected in groups of four flues each to horizontal bus channels 22 by passage 24. This passage area is adjustable above each flue 20 by means of a slidable brick 23. Each horizontal bus channel 22 servicing a group of four flues communicates by cross-over duct 26 with an identical horizontal bus channel and grouping of flues on the opposite side of coking chamber 12. Rich gas nozzles 36 situated in the bottom of heating flues 20 are connected by feed lines 38 to rich gas ducts 40 for underfiring with rich gas.

Regenerators 28, 30, 32 and 34 connect with regenerator sole ducts 28′, 30′, 32′ and 34′ and with transfer ducts 28″, 30″, 32″ and 34″, respectively. The transfer ducts communicate with header ducts 42 within header wall 44. Outlet slots 46 connect the header ducts 42 with the heating flues 20 situated on either side. The outlet slots 46 enter the heating flues at multiple levels along the vertical length of the header wall. The cross-section of the slots may be uniform throughout substantially the entire length of the header duct or they may vary linearly or in any relationship as test conditions warrant.

In operation, coal is charged through charging hole 14 and leveled in coking chamber 12 by conventional means. For this illustration the "on" flues are those having the upwardly pointing arrows and the "off" flues are those having the downwardly pointing arrows in FIG. 3. Coking proceeds by combusting air and lean gas, for example, in the "on" heating flues 20. The lean gas is supplied via regenerator sole ducts 28′ from which it passes through the hot checker-brickwork of regenerator 28 where it is heated. The heated lean gas leaves the regenerator through transfer ducts 28″ entering header ducts 42 and passing into heating flues 20 through the outlet slots 46. Air is similarly supplied to the heating flues via regenerator sole ducts 30′, regenerators 30 where the air is heated in the hot checker-brickwork, then the transfer ducts 30″, header ducts 42 and finally outlet slots 46. In the arrangement shown in the FIGURES when adjacent regenerators carry the same gas, that is to say two regenerators next to each other both carry lean gas or waste gas, it may be preferable to combine these two adjacent regenerators into a larger single regenerator. For example, adjacent regenerators designated 28 are shown to be of individual construction and are both conveying lean gas. These may be combined into one large regenerator rather than two individual ones.

The waste gases produced by the combustion of the air and lean gas in the "on" heating flues pass upward and into horizontal bus channels 22 via passages 24. The waste gases from four "on" heating flues combine in the horizontal bus channel 22 and are conveyed through the cross-over duct 26 as indicated by the arrows in FIG. 3 into a second horizontal bus channel 22 located on the opposite side of coking chamber 12. From this second horizontal bus channel the waste gases are distributed through passages 24 into the "off" heating flues 20 and exit via outlet slots 46, and the associated header duct 42 and transfer ducts 32″ and 34″ to enter regenerators 32 and 34, respectively. In regenerators 32 and 34 the heat content of the waste gases is captured by the checker-brickwork before the waste gases are conducted from the coke oven battery via regenerator sole flues 32′ and 34′ and waste gas exhaust means not shown.

On the reverse cycle, combustion occurs in those heating flues that were previously "off" and the waste gases are removed in the heating flues that were previously "on". In other words, as shown in FIG. 3, the "on" flues are now "off" and vice versa. Regenerator sole flues 34′, regenerators 34 and transfer ducts 34″ now carry lean gas instead of waste gases, while regenerator sole flues 32′, regenerators 32 and transfer ducts 32″ carry air. The arrows of the FIG. 3 would be reversed to indicate the flow of the waste gases out the flues through regenerators 28 and 30 and their associated elements. Previously, the checker-brickwork of regenerators 32 and 34 had abstracted a substantial amount of the heat content of the waste gases flowing through them and their associated heating flues during their "off" cycle. On the reverse cycle when these heating flues are "on", the air and lean gas to be combusted in the flues are preheated as they course through the hot checker-brickwork of regenerators 32 and 34, respectively.

When rich gas is used to fire the coke ovens instead of lean gas, it is furnished to the "on" heating flues via rich gas ducts 40, feed-lines 38 and rich gas nozzles 36 which contain adjustable orifices, not shown, for regulating the quantity of rich gas delivered. Both groups of regenerators that communicate with the "on" heating flues now carry air. For example, regenerators 28 and 30 and their associated elements would conduct air for combustion of the rich gas in the "on" heating flues while the waste gases would exhaust from the "off" heating flues via regenerators 32 and 34. On reverse cycle, regenerators 32 and 34 would carry air and regenerators 28 and 30 would carry the waste gas.

As shown in FIG. 3 and described above, the heating walls in which combustion occurs are operated in a sequence such that every other coking chamber is between heating walls which are both burning "on" or are both "off" carrying waste gases. In other words these coking chambers are located between heating walls whose flues do not connect the walls to each other by cross-over ducts. There are no cross-over ducts located in the battery construction above these coking chambers. Alternating with these coking chambers are coking chambers that are beneath cross-over ducts and between heating walls whose heating flues connect the walls to each other by cross-over ducts. These latter coking chambers always have an "on" and an "off" flue on either side.

While the above method of operating the heating cycle is preferred, it is also possible to burn the combustion gases in every other heating wall flue system such that "on" and "off" heating walls alternate the length of the coke oven battery and the waste gases are carried in the same direction in all the cross-over ducts in the battery. That is to say every coking chamber is sandwiched between the "on" and an "off" flue. Accordingly, the air, lean gas and waste gases will have to be appropriately directed to those regenerators associated with the flues that will carry the particular gas. The regenerator must then be of the individual construction as shown in the FIGURES and may not be combined for sharing.

The illustrated coke oven heating system grouping four vertical heating flues together via a horizontal bus channel merely illustrates the invention of combining a multistage heating system with a horizontal bus channel and cross-over duct whereby the vertical temperature profile of the coke cake is maintained more constant throughout its length. A smaller or larger number of heating flues can be grouped together via a single horizontal bus channel as described in the above embodiment and still be within the spirit of the invention.

Further embodiments of regenerative coke oven batteries incorporating the invention may have pairs of header ducts within each header wall. Both lean gas and air may then be carried individually through each header wall in its own duct and conveyed by outlet slots to one heating flue or to the two heating flues on either side of the header walls. More information regarding such combinations of header ducts conveying air and lean gas, the outlets and the arrangement of the regenerators associated with those header ducts can be had in U.S. Pat. No. 3,801,470 disclosing the Firma Carl Still multistage heating system. In addition, the number of ducts 46 in each flue would be determined by the height of the battery and conditions of operation such as characteristics of the coal, coking rate, etc.

I claim:

1. In a regenerative coke oven battery heated with rich gas or lean gas having a plurality of horizontal coking chambers and between each coking chamber a heating wall containing a plurality of vertical heating flues and including regenerators which communicate via duct work with the heating flues and also with waste gas exhaust means and lean gas and air sources, the improvement comprising said vertical heating flues defined by header walls provided with header ducts and multilevel outlet slots connecting the header ducts and the heating flues, a plurality of horizontal bus channels, each channel located above and communicating with a group of adjacent vertical heating flues, and a plurality of cross-over ducts each connecting the horizontal bus channel of a first group of adjacent flues with the horizontal bus channel of a second group of adjacent flues which second group is located on the opposite side of a coking chamber from the first group whereby a coke cake produced in this regenerative coke oven battery has a low vertical temperature differential.

2. The invention of claim 1 wherein the horizontal bus channels combine together four adjacent vertical heating flues.

3. The invention of claims 1 or 2 wherein the header walls contain a pair of ducts for passage of air and lean gas.

* * * * *